US005217079A

United States Patent [19]

Kettner et al.

[11] Patent Number: 5,217,079

[45] Date of Patent: Jun. 8, 1993

[54] HYDRO-IMPULSE SCREWING DEVICE

[75] Inventors: Konrad K. Kettner; Heinz-Gerhard Anders, both of Aalen; Eugen Mattheiss, Lauchheim, all of Fed. Rep. of Germany

[73] Assignee: Cooper Industries, Inc., Houston, Tex.

[21] Appl. No.: 756,243

[22] Filed: Sep. 6, 1991

Related U.S. Application Data

[63] Continuation of Ser. No. 197,923, May 24, 1988, abandoned.

[30] Foreign Application Priority Data

May 5, 1987 [DE] Fed. Rep. of Germany ..... 38797

[51] Int. Cl.[5] ..... B25B 23/14

[52] U.S. Cl. ..... 173/177; 173/93; 91/59

[58] Field of Search ..... 173/93, 93.5, 5, 6, 173/7, 12, 104; 91/59

[56] References Cited

U.S. PATENT DOCUMENTS

| | | | |
|---|---|---|---|
| 3,334,487 | 8/1967 | Pauley | 60/54.5 |
| 3,387,669 | 6/1968 | Wise, Jr. et al. | 173/12 |
| 3,908,766 | 9/1975 | Hess | 173/93.5 |
| 4,175,408 | 11/1979 | Kasai et al. | 64/26 |
| 4,278,427 | 7/1981 | Lingenhöle et al. | 91/59 |
| 4,418,764 | 12/1983 | Mizobe | 173/12 |
| 4,604,943 | 8/1986 | Pauley | 91/59 |
| 4,721,166 | 1/1988 | Clapp et al. | 91/59 |
| 4,844,176 | 7/1989 | Podsobinski | 91/59 |

FOREIGN PATENT DOCUMENTS

| | | |
|---|---|---|
| 0070325 | 1/1983 | European Pat. Off. . |
| 3347016 | 7/1985 | Fed. Rep. of Germany . |
| 2170435 | 8/1986 | United Kingdom . |

*Primary Examiner*—Frank T. Yost
*Assistant Examiner*—Scott A. Smith
*Attorney, Agent, or Firm*—Alan R. Thiele; David A. Rose

[57] ABSTRACT

A hydro-impulse screwing device comprises a rotary drive motor, a power source for the motor, a drive shaft, a pulsating hydraulic drive connecting the motor to the shaft and a power cut-off for the motor. The load at which the power cut-off functions is adjustable. The tool has a borehole extending through the length of the shaft, a conduit for conducting hydraulic fluid from the drive to the borehole, a valve in the borehole movable from a closed position to an open position in response to hydraulic pressure corresponding to a predetermined load to allow hydraulic pressure from the drive to actuate the power cut-off, a biassing element in the borehole for biassing the valve toward a closed position against the hydraulic pressure, wherein the force of the biassing element is adjusted at the end of the drive shaft to change the load at which the power cut-off operates.

2 Claims, 2 Drawing Sheets

HYDRO-IMPULSE SCREWING DEVICE

This is a continuation of copending application Ser. No. 07/197,923 filed on May 24, 1988 now abandoned.

BACKGROUND OF THE INVENTION

The drive shaft is activated with thrusts by the impact machine with such hydro-impulse screwing devices causing the drive shaft and therefore the screwing tool which is connected to it to turn by a series of impulses. When working with screw connections, the screws or nuts have to be tightened up to a predetermined rotation momentum. The conventional hydro-impulse screwing devices are designed in such a way that they automatically interrupt the screwing process. This conventional screwing device is equipped with a timer for the determination of the turn-off time which is activated while tightening the screw head or when the nut is at the pieces which are to be screwed together, and the drive shaft is activated by thrusts. After a predetermined time, then, the timer turns the screwing device off. Since the time period of the timer is used as a criterion for switching off, there is no certainty of whether or not the screw or the nut is tightened with the required rotation momentum during the time of the turn-off.

SUMMARY OF THE INVENTION

It is the task of the invention to design a hydro-impulse screwing device in such a way that it turns off only when reaching the predetermined limit of the rotation momentum during the tightening process.

According to the invention, this problem is solved with the hydro-impulse screwing device in question with the characteristics of claim 1.

With the hydro-impulse screwing device of the invention, the criterion for the turn-off time is the pressure in the cylinder chamber of the impact machine which is proportional to the respective rotation momentum. Thus the screwing device of the invention is turned off only if the appropriate pressure and therefore the desired tightening rotation momentum is reached. An increase in the tightening rotation momentum increases the pressure in the cylinder chamber so that this pressure serves as a standard for the respective tightening rotation momentum. This pressure of the hydraulic medium in the cylinder chamber is subsequently used for the release of the turn-off mechanism with which the screwing device is automatically turned off after reaching the limit of the rotation momentum. With the design of this invention, the problem of premature cessation of the screwing process is avoided.

Other characteristics of the invention are described in other claims, the explanation, and the figures.

BRIEF DESCRIPTION OF THE DRAWINGS

The invention is further explained with an example shown in the figures. They show FIG. 1 - a cross section through a hydro-impulse screwing device of this invention.

DESCRIPTION OF THE PREFERRED EMBODIMENT

Figure 1:
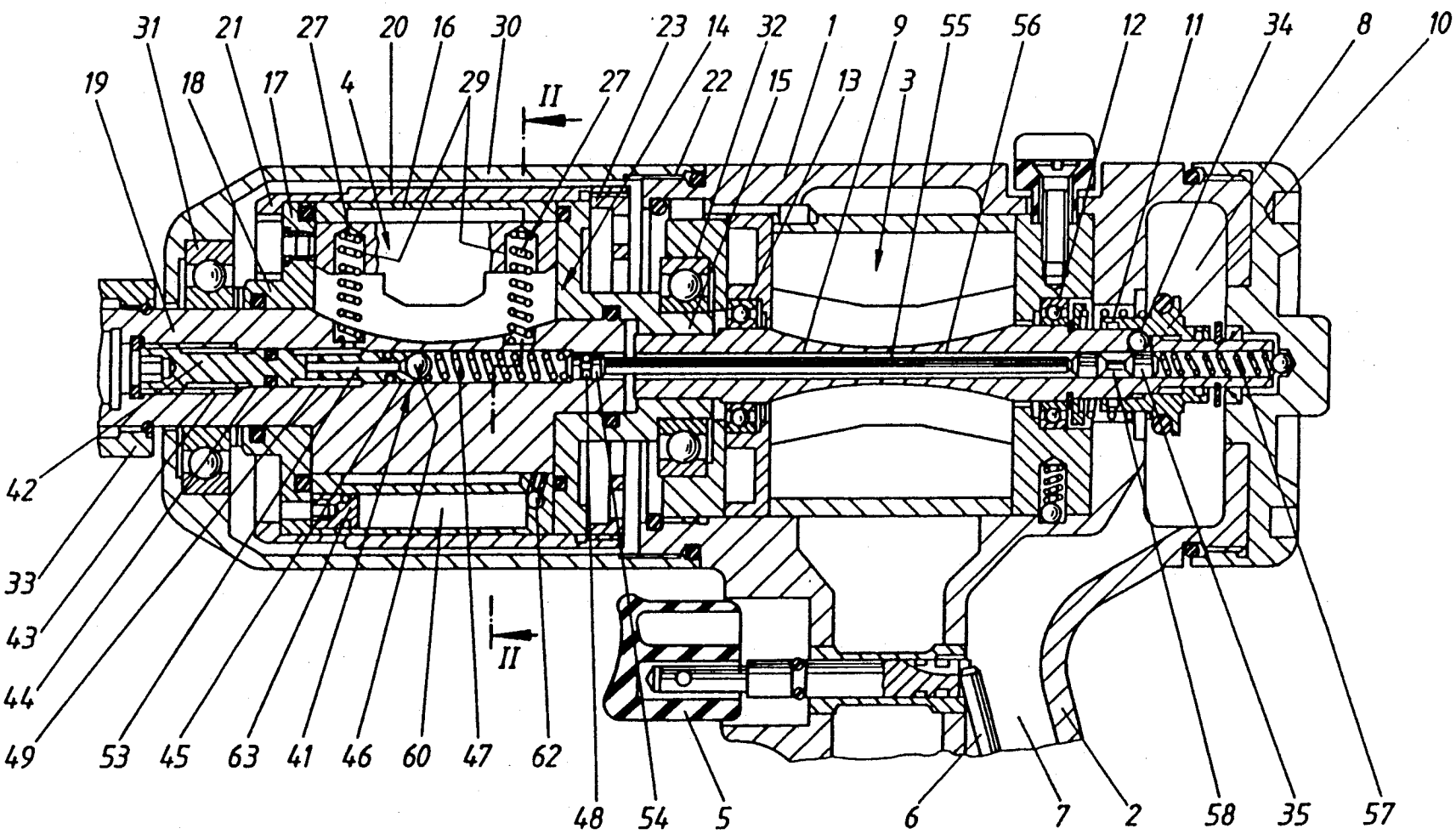

The hydro-impulse screwing device has casing 1 with handle 2. In casing 1 there is compressed air motor 3 and impact machine 4. In handle 2 there is switch 5 which can activate tipper valve 6. It lies in compressed air supply line 7 in handle 2. The handle has a conventional (not shown) compressed air connection. Compressed air supply line 7 ends in compressed air chamber 8 in casing 1 which can be closed against compressed air motor 3 by pivoting stop valve 10 which is axially placed on motor shaft 9. Stop valve 10 can be pushed into its closing position against the force of pressure spring 11 which surrounds motor shaft 9. Motor shaft 9 is placed in a rotating way in casing 1 via two antifriction bearings 12 and 13. At the end of motor shaft 9, opposed to stop valve 10, there is sleeve-shaped end piece 15 of impact machine lid 14 of impact machine 4. Impact machine lid 14 lies vertically to the axis of motor shaft 9 and in a rotating manner is connected by cylinder piece 16 to opposite impact machine lid 17 at the outer radial end. Impact machine lid 17 is placed with sleeve-shaped end piece 18 on drive shaft 19, where end piece 15 of impact machine lid 14 is placed, too. Drive shaft 19 ends at a small distance from motor shaft 9. Two impact machine lids 14, 17 and cylinder piece 16 are surrounded by cylindrical support piece 20 which engages in impact machine lid 17 at the outer radial edge with radial collar 21 directed toward the inside; at its opposite end there is indentation 22 into which tension ring 23 is screwed which tightens impact machine lids 14, 17 and cylinder piece 16 against collar 21.

Impact machine lids 14 and 17 as well as cylinder piece 16 limit cylinder chamber 24 (FIG. 2) which is designed eccentrically in the cylinder of impact machine 4 formed by cylinder piece 16. Drive shaft 19 goes through this cylinder chamber 24 and is arranged eccentrically in relationship to the axis of this cylinder chamber 24. Drive shaft 19 in the area of cylinder chamber 24 is designed as an impulse anvil which has the shape shown in FIGS. 2 and 4. In the area outside cylinder chamber 24 there is the cylindrical drive shaft. Drive shaft 19 inside cylinder chamber 24 has indentation 25 (FIG. 2) which reaches over the length of cylinder chamber 24 and which holds radial pivoting lamella 26. It acts under the force of two pressure springs 27 (FIG. 1) which are pressing lamella 26 radially outwards against inner wall 28 (FIG. 2) of cylinder piece 16. Pressure springs 27 with one end lie in indentations 29 in lamella 26.

Cylinder piece 16 is surrounded by casing 1 forming ring slit 30. Drive shaft 19 is placed into casing 1 with antifriction bearings 31, 32 so that it can turn. At the end of drive shaft 19 which protrudes out of casing I there is rotating receiver 33, for example a tension lining, for the screwing tools.

Relative to impact machine lids 14, 17 and to cylinder piece 16 drive shaft 19 is rotating. Cylinder chamber 24 is completely filled with a pressure medium, preferably with pressurized oil.

In order to start the hydro-impulse screwing device, switch 5 is activated so that tipping valve 6 returns into its open position and compressed air reaches compressed air chamber 8 via compressed air supply line 7. Stop valve 10 is held in its open position by stop sphere 34 which is placed to radially pivot into motor shaft 9, and by stop piston 35. Thus the compressed air can reach compressed air motor 3 through open stop valve 10 and can drive it in the conventional way. Motor shaft 9 of compressed air motor 3 immediately drives impact machine lids 14 and 17 and cylinder piece 16. Thus via the pressure medium in cylinder chamber 24, drive shaft 19 also is carried along in a rotating way. This causes the screwing tool which is inserted in receiver 33 to turn and to screw a screw or nut in the respective construction piece. As long as the screw head or the nut is not completely adjusted, motor shaft 9 and drive shaft 19 both turn. But as soon as the screw head or the nut are placed firmly, drive shaft 19 receives a counter force. In order to tighten the screw or nut, it is now necessary to apply a rotation momentum to the screw or the nut with drive shaft 19. Since motor shaft 9 with impact machine lids 14, 17 and cylinder piece 16 rotates against drive shaft 19, the motor shaft continues to be driven in a rotating way so that cylinders 14, 16, 17 turn relative to drive shaft 19.

Figure 2:
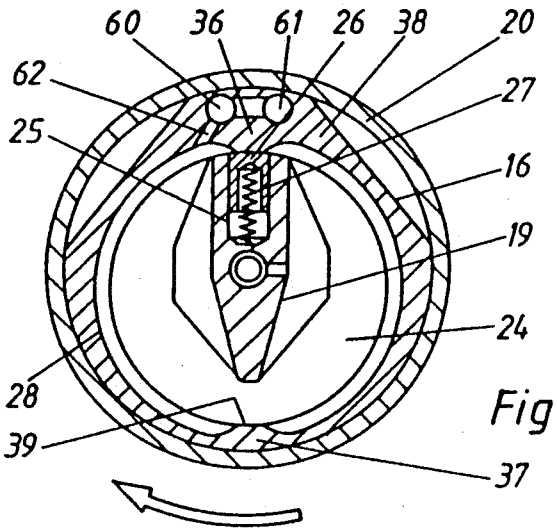
FIG. 2 - a cross section through an impact machine of the hydro-impulse screwing device in the position in which no thrust is exerted on the drive shaft.

As FIG. 2 shows, two radial inwardly-protruding and diametrically opposing sealing strips 36 and 37 are provided at inner wall 28 of cylinder piece 16 which are designed in one piece with cylinder piece 16 and have sides 38 and 39 which act as a sealing surface which runs coaxially to the cylindrical inner wall 28.

Figure 4:
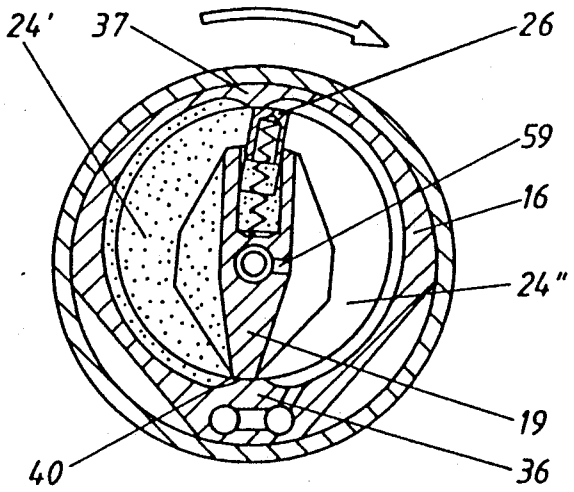
FIGS. 4 and 5 - presentations according to FIGS. 2 and 3 which show the impact machine and the rotation momentum adjustment mechanism in a position in which a thrust is exerted to the drive shaft.

Because of the eccentric arrangement of drive shaft 19 in cylinder chamber 24, during the major part of cylinder rotation 16 only lamella 26 of drive shaft 19 touches inner wall 28 of cylinder piece 16. Pressure springs 27 press lamella 26 against inner wall 28 where they remain during the rotation of cylinder piece 26. As soon as cylinder piece 16 gets into the position relative to the drive shaft which is shown in FIG. 4, lamella 26 and opposing outer side 40 of drive shaft 19 are touching simultaneously sealing strips 36 and 37. With this, cylinder chamber 24 is divided into two cylinder chambers 24', 24" which are sealed against each other by lamella 26 and drive shaft 19. The hydraulic medium in cylinder chamber 24' is put under pressure because the medium cannot escape anymore into cylinder chamber 24". The pressure thus created is transferred to the part of drive shaft 19 which is in the cylinder chamber, which causes it to turn through a series of thrusts into the direction of the rotation of cylinder piece 16. As soon as the sealing position shown in FIG. 4 is passed, edge 40 of drive shaft 19 becomes free from sealing strip 36, so that the hydraulic medium from cylinder chamber 24' can reach cylinder chamber 24" again. Since during the sealing position (FIG. 4) the hydraulic medium cannot or can only very slowly escape from cylinder chamber 24', cylinder piece 16, and with that, compressed air motor 3 is stopped. However, as soon as the sealing position is passed and pressure can be reduced, compressed air motor 3 accelerates again until after one rotation the sealing position shown in FIG. 4 is reached again. By this method, drive shaft 19 and thus the respective screwing tool is turned by a series of impulses.

Since screws or nuts have to be tightened up to a predetermined rotation momentum, it is necessary to stop the screwing process exactly at these predetermined limits of the rotation momentum. With the hydro-impulse screwing device, the pressure which is created in cylinder chamber 24 in the sealing position of drive shaft 19 determines the moment for turning off the rotation momentum limit. For this purpose the screwing device is equipped with rotation momentum adjustment installation 41 (FIG. 1) with which the screwing device can be completely and automatically turned off when the predetermined rotation momentum limit is reached depending on the hydraulic pressure in cylinder chamber 24. Rotation momentum adjustment installation 41 has adjustment screw 42 which is screwed into coaxial shaft perforation 43 in drive shaft 19. Because of this arrangement, adjustment screw 42 is easily accessible for the adjustment of the turn-off momentum of the screwing device. Adjustment screw 42 reaches into a centrical perforation which is behind shaft perforation 44 and which goes through drive shaft 19. The end of adjustment screw 42 which is in perforation 44 is designed as valve seat 45 where valve sphere 46 lies under the force of pressure spring 47. Pressure spring 47 is also in centrical perforation 44 of drive shaft 19 and is supported by ledge 48 of the drive shaft at the end which is opposite to valve sphere 46.

Figure 3:
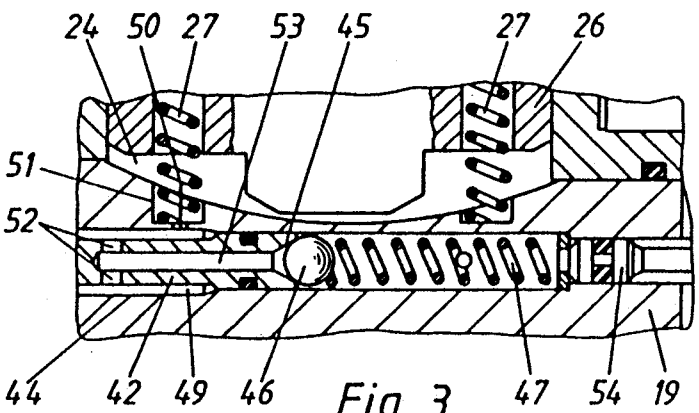
FIG. 3 - an enlarged presentation and a cross section of the position of a rotation momentum adjustment mechanism in the position of the impact machine shown in FIG. 2.

As can be clearly seen in FIG. 3, in the area between valve seat 45 and the side where the screwing action is to take place (FIG. 1), adjustment screw 42 is smaller than perforation 44 of drive shaft 19. This forms ring chamber 49 which surrounds adjustment screw 42 and which is connected to cylinder chamber 24 by perforation 50 in drive shaft 19. Perforation 50 is at the bottom of an indentation in the part of drive shaft 19 which is in cylinder chamber 24 and which holds pressure spring 27 for lamella 26. Ring chamber 49 is sealed in both axial directions of adjustment screw 42, so that the hydraulic medium coming from cylinder chamber 24 and going into ring chamber 49 cannot escape outside or into the screwing device via perforation 44.

By at least one, in the example of the design by two diametrically opposed perforations 52 (FIG. 3) is ring chamber 49 connected to valve perforation 53 which runs centrically in adjustment screw 42 and which ends in valve seat 45. Releaser piston 54 is connected to pressure spring 47 for valve sphere 46. Releaser piston 54 acts like a sealing agent in perforation 44 of drive 19 and lies against stopper 55 which is arranged in perforation 56 which goes centrically through motor shaft 9. Stopper 55 also lies against stop piston 35 which is under the force of pressure spring 57 which is in perforation 56. When the hydro-impulse screwing device runs, releaser piston 54 and stop piston 35 assume the position shown in FIG. 1. During the screwing process, drive shaft 19 is turned by a series of impulses as described before if the screw or the nut is on the pieces to be screwed. With the increasing rotation angle, the necessary rotation momentum also increases. The appropriate limit of the rotation momentum can be adjusted with rotation momentum adjustment device 41; the screwing device turns off automatically when this limit is reached. With each rotation of cylinder piece 16, the pressure in cylinder chamber 24' increases in the sealing position of drive shaft 19. Since cylinder chamber 24' is connected to ring chamber 49 via perforation 50 and to valve perforation 53 via perforations 52, the pressure in cylinder chamber 24' also affects valve sphere 46. By pressure spring 47 it is pressed into valve seat 45 by a predetermined force. With an increasing number of thrusts via drive shaft 16, the pressure of the hydraulic medium rises in cylinder chamber 24' and also with that in valve perforation 53. As soon as this pressure surpasses the spring force exerted on valve sphere 46, the valve sphere is lifted from valve seat 45 so that a small amount of the hydraulic medium escapes from valve perforation 53 into perforation 44 of drive shaft 19 in the area between adjustment screw 42 and release piston 54. It is pushed to the right by the hydraulic medium of FIG. 2 which causes stop piston 35 to be pushed against the force of pressure spring 57 via stopper 55. Stop piston 35 has ring groove 58 which thus gets into the area of stop sphere 34 which can escape radially inwards and which frees stop valve 10. Because of the pressure existing in compressed air chamber 8, stop valve 10 is pressed into its closing position against the force of pressure spring 11. This causes the compressed air supply to motor 3 to be interrupted and to stop the screwing device immediately.

The dimensions of valve perforation 53 and release piston 54 are selected in such a way that immediately after reaching the predetermined pressure of the hydraulic medium, release piston 54 in perforation 44 of drive shaft 19 is displaced. The force of pressure spring 57 is adjusted in such a way that release piston 54 can easily push stop piston 35 via stopper 55. After turning off compressed air motor 3, drive shaft 19 stops immediately so that the screwing tool actually stops at the desired limit of the rotation momentum, too, and the screw or nut which is to be screwed is not overtightened. After turning off the motor, a pressure decrease occurs in cylinder chamber 24 as well as in compressed air chamber 8 so that the pieces causing the screwing device to turn off return to their initial position as shown in FIG. 1. Pressure spring 11 pushes stop valve 10 back into its releasing position, while pressure spring 57 pushes stop piston 35 via stopper 55 and releaser piston 54 back into their initial positions shown in FIGS. 1 and 3. Finally, pressure spring 47 presses valve sphere 46 back into valve seat 45. With that the screwing device is ready for the next screwing process.

The turn-off time and thus the rotation momentum limit can be adjusted smoothly with adjustment screw 42. Turning adjustment screw 42 puts an appropriate initial tension on pressure spring 47 so that according to the desired rotation momentum limit and thus the turn-off time, the pressure of the hydraulic medium necessary for lifting valve sphere 46 can be precisely adjusted. Ring chamber 49 is long enough so that even at a minimum adjustment of adjustment screw 42 in both directions there is still a connection line to cylinder chamber 24 via perforation 50.

Figure 5:
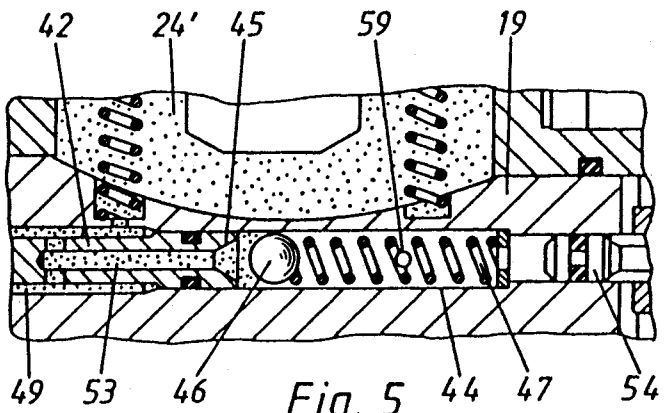

Compressed air motor 3 is preferably a reversible motor so that motor shaft 9 and drive shaft 19 can be driven in the opposite rotation direction, too, making it possible to loosen screws and nuts. This causes the hydraulic pressure to rise immediately after turning the screwing device on in the other cylinder chamber 24'' when the sealing position is reached according to FIG. 4. Cylinder chamber 24'', via perforation 59 (FIGS. 4 and 5) is connected to perforation 44 of drive shaft 19 in the area between adjustment screw 42 and release piston 54. Thus the hydraulic pressure exerted in cylinder chamber 24'' at the reverse movement, via perforation 59, affects valve sphere 46 and presses it firmly into valve seat 45 making it impossible to turn off the screwing device during the backward movement, i.e. when loosening screws and nuts. The dimensions of perforation 59 in drive shaft 19 are such that the amount of oil which flows through perforation 44 of drive shaft 19 is not sufficient to push releaser piston 54. Since sealing sticks 36 and 37 are relatively narrow in comparison to the circumference of inner wall 28 of cylinder piece 16, there is pressure in cylinder chamber 24'' at the backward movement only during a very short time as compared with the time necessary for the other rotation of cylinder piece 16. During this relatively long time, the oil in perforation 44 can flow back into cylinder chamber 24 avoiding oil accumulation at the next series of impulses of drive shaft 19. This reliably avoids a constantly increasing volume being created at the backward movement in cylinder chamber 24'' which could push release piston 54 and cause the motor to turn off.

During the backward movement, the screwing device is turned off in the conventional way by releasing switch 5 which causes tipping valve 6 to close and to interrupt the compressed air supply.

There are two adjustment perforations 60 and 61 (FIG. 2) in a reinforced area of the wall of casing piece 16 which are also filled with the hydraulic medium. Both adjustment perforations 60 and 61 are connected with each other, and adjustment perforation 60 in addition is connected to cylinder chamber 24 via perforation 62. Adjustment perforations 60 and 61 can receive a hydraulic medium from cylinder chamber 24 if it expands because of a temperature increase. Furthermore, via the adjustment perforations, losses of hydraulic medium through leaks can be compensated. Piston 63 is screwed into adjustment perforation 60 on one end (FIG. 1). An additional piston is provided at the opposite end of adjustment perforation 61 (not shown), which closes this adjustment perforation at the free end. One of adjustment perforations 60 is completely filled with a hydraulic medium while the other adjustment perforation is only partially filled with the hydraulic medium. According to the amount of the hydraulic medium in both adjustment perforations, the piston (not shown) of one of the adjustment perforations can be displaced according to the amount of the hydraulic medium in this perforation. With the described hydro-impulse screwing device, the sealing proportions between drive shaft 19 and casing piece 16 do not change when working with the screwing device since there is an automatic switch-off for the screwing device via rotation momentum adjustment installation 41 in the drive shaft. This makes it possible for the screwing device to work independently of the fact that soft or hard pieces are to be screwed together, with the same thrust frequency. This causes the screwing device to maintain the thrust frequency of impact machine 4 on a suitable value where a temperature increase of the hydraulic medium does not occur or occurs only very little. This maintains the viscosity of the hydraulic medium to be approximately stable when the screwing device is working. If, because of a temperature increase, the hydraulic medium became thinner, there would exist the danger that the desired pressure in cylinder chamber 24', which is necessary for opening valve sphere 46, would not be reached during the screwing process, so that the screwing device could not be turned off automatically either. But since the screwing device works with an optimal number of thrusts in relationship to the heating of the hydraulic medium, the viscosity of the hydraulic medium remains approximately constant so that the screwing devices can be turned off reliably at the predetermined rotation momentum.

In order to further reduce the heating of the hydraulic medium, there is ring slit 30 provided between screwing device casing 1 and support piece 20. Compressed air motor 3 generates an air stream which can reach ring slit 30 via antifriction bearings 13 and 32.

Since it is narrow, only a few tenths of millimeters, the air passes with a relatively high speed through ring chamber 30 and thus intensely cools support piece 20 and with that also cylinder piece 16. Then the air passes forward and out of screwing device casing 1 via anti-friction bearings 31 and the passage for drive shaft 19. Naturally, it is possible to provide, in addition, nuts in support piece 20 in order to expand the surface for the cooling air.

We claim:

1. In an impulse tool comprising a rotary drive motor, a power source connected to power said motor, a drive shaft having a work driving end extending form said impulse tool, a pulsating hydraulic drive connecting said motor to said drive shaft, and power cut-off means for cutting off the power to said motor, means for adjusting the load at which the power cut-off means functions, comprising a central borehole extending throughout the length of said drive shaft, a conduit for conducting hydraulic fluid from said hydraulic drive to said borehole, hydraulically-actuable means in said borehole operatively connected to said power cut-off means, a valve in said borehole movable from a closed position preventing flow of hydraulic fluid through said conduit to an open position in response to hydraulic pressure corresponding to said predetermined load to allow hydraulic pressure from said pulsating hydraulic drive to actuate said hydraulically-actuable means to operate said power cut-off means, biasing means in said borehole biasing said valve toward a closed position against said hydraulic pressure, and means operable from the work driving end of the drive shaft for adjusting the force of said biasing means to change the load at which the power cut-off means operates.

2. An impulse tool as defined by claim 1 wherein the hydraulically actuable means includes a piston in said borehole movable longitudinally in response to hydraulic pressure when said valve is open, and a longitudinally extending rod operably engaging said piston and said power cut-off means.

* * * * *